US005092142A

United States Patent [19]

Zane et al.

[11] Patent Number: 5,092,142

[45] Date of Patent: * Mar. 3, 1992

[54] BICYCLE LOCK

[75] Inventors: Michael S. Zane, Cambridge; Peter L. Zane, Hingham, both of Mass.

[73] Assignee: Kryptonite Corporation, Boston, Mass.

[ * ] Notice: The portion of the term of this patent subsequent to Apr. 30, 2008 has been disclaimed.

[21] Appl. No.: 654,790

[22] Filed: Feb. 11, 1991

Related U.S. Application Data

[63] Continuation of Ser. No. 514,175, Apr. 25, 1990, Pat. No. 5,010,746.

[51] Int. Cl.[5] ..... F05B 67/04

[52] U.S. Cl. ..... 70/39; 70/55; 70/233

[58] Field of Search ..... 70/38–47, 70/233, 238, 55

[56] References Cited

U.S. PATENT DOCUMENTS

| | | | |
|---|---|---|---|
| 187,362 | 2/1877 | Dilg . | |
| 238,548 | 1/1976 | Seakan | 0.8/114 |
| 263,212 | 8/1882 | Pettibone . | |
| 491,102 | 2/1893 | Halldén . | |
| 584,575 | 6/1897 | Cornell . | |
| 1,036,992 | 8/1912 | Franki . | |
| 1,384,590 | 7/1921 | Bottone . | |
| 1,424,543 | 8/1922 | Wiloch . | |
| 1,461,725 | 7/1923 | Cooper . | |
| 1,503,210 | 7/1924 | Shannon . | |
| 1,542,016 | 6/1924 | Stull . | |
| 1,618,924 | 2/1927 | Hanton . | |
| 1,629,859 | 5/1927 | Burke . | |
| 1,638,264 | 8/1927 | Junkung . | |
| 1,679,665 | 8/1928 | Junkung . | |
| 1,690,938 | 11/1928 | Maxwell . | |
| 2,471,291 | 5/1949 | Sorefetal | 76/38 |
| 3,721,112 | 3/1973 | Wellekens | 70/39 |
| 3,739,607 | 6/1973 | Smedley | 70/18 |
| 3,754,418 | 8/1973 | Miller | 70/18 |
| 3,755,778 | 8/1973 | Kennedy et al. | 340/65 |
| 3,777,517 | 12/1973 | Shwayder et al. | 70/53 |
| 3,800,570 | 4/1974 | Kaplan | 70/18 |
| 3,855,826 | 12/1974 | Hori | 70/38 |
| 3,924,426 | 12/1975 | Zane et al. | 70/18 |
| 3,967,475 | 7/1976 | Zane | 70/18 |
| 4,064,716 | 12/1977 | Shwayder et al. | 70/38 |
| 4,085,600 | 4/1978 | Bindari | 70/39 |
| 4,155,231 | 5/1979 | Zane et al. | 70/18 |
| 4,256,322 | 3/1981 | Otsuka et al. | 280/289 |
| 4,271,690 | 6/1981 | Jaulmes | 70/233 |
| 4,324,911 | 4/1982 | Mitton | 70/233 |
| 4,426,861 | 1/1984 | Chillis | 70/39 |
| 4,524,591 | 6/1985 | Lanka | 70/236 |
| 4,545,224 | 10/1985 | Zane | 70/39 |
| 4,584,855 | 4/1986 | Burlingame | 70/38 |
| 4,674,306 | 6/1987 | Halpern | 70/233 |
| 4,730,470 | 3/1988 | Zane et al. | 70/238 |
| 4,823,566 | 4/1989 | Patton | 70/38 |
| 4,823,567 | 4/1989 | Patton | 70/38 |
| 4,870,843 | 10/1989 | Lunberg | 70/233 |
| 4,881,387 | 11/1989 | Kortenbrede | 70/39 |
| 4,918,949 | 4/1990 | Newbold | 70/39 |
| 4,987,753 | 1/1991 | Kuo | 70/39 |
| 5,010,746 | 4/1991 | Zane et al. | 70/39 |

FOREIGN PATENT DOCUMENTS

| | | |
|---|---|---|
| 92289 | 11/1961 | Denmark . |
| 105187 | 7/1898 | Fed. Rep. of Germany . |
| 111976 | 9/1898 | Fed. Rep. of Germany . |
| 376842 | 6/1923 | Fed. Rep. of Germany . |
| 388160 | 1/1924 | Fed. Rep. of Germany . |
| 491840 | 2/1930 | Fed. Rep. of Germany . |
| 824896 | 7/1949 | Fed. Rep. of Germany . |
| 182417 | 6/1921 | United Kingdom . |
| 471118 | 8/1937 | United Kingdom . |

*Primary Examiner*—Gary L. Smith
*Assistant Examiner*—Suzanne L. Dino
*Attorney, Agent, or Firm*—Morse, Altman, Dacey & Benson

[57] ABSTRACT

An improved bicycle lock, featuring a U-shaped shackle, a cross bar and means for securing one to the other, is disclosed. The means for securing the shackle to the cross bar also functions as a fulcrum, permitting a tilting movement between the two parts, required in assembling and dissassembling them. The means further includes a locking mechanism removably mounted in the cross bar in between the shackle's legs, and features a dead bolt. The cross bar extends beyond the shackle's legs less than twice the diameter of one of those legs, resulting in a compact and sturdy design. A plastic cover encloses at least the cross bar and is preferably formed of two parts slidably fitted over the cross bar, with means for securing the two parts to one another. Preferably, an environmental protection means is provided for the locking mechanism.

10 Claims, 6 Drawing Sheets

119
109
118
34a
107
117
116
16
106

119C
119B
118B
117B
106
116B 119C
118C
113
111
106
117C
116C 115
118D
117
106
116D 101
91
91
93
103
106
93

BICYCLE LOCK

This is a continuation application of application Ser. No. 07/514,175, filed Sept. 25, 1990 of Michael S. Zane and Peter L. Zane now U.S. Pat. No. 5,010,746.

BACKGROUND OF THE INVENTION

1. Field of the Invention present invention relates generally to locks and, more particularly, to an improved lock for bicycles, motorcycles, scooters, mopeds and the like.

2. The Prior Art

The numbers of bicycles, motorcycles scooters, mopeds and the like in daily use have increased dramatically lately. Some of these items are now quite expensive. Thefts of these items also have increased dramatically. These items, once stolen, represent not only considerable loss to their owners, but also are difficult to trace and to recover. Professional and some not so professional thieves nowadays frequently employ a bolt cutter, a long lever or the like to sever or break quickly and quietly cables, chains or other devices used to secure bicycles and the like to posts or other fixed objects. To guard thereagainst, large heavy locks have been developed comprising rigid U-shaped shackles and cross bars designed to attach to the ends of the shackles. See U.S. Pat. Nos. 3,924,426; 3,967,475 and 4,155,231. These devices offer good resistance to bolt cutters, hack saws and the like.

More recently, a bicycle lock featuring a replaceable lock cylinder which may be identical to one used in the home or office and operable by the same key, has been developed. See the U.S Pat. No. 4,545,224.

The present invention is an improvement over the Bicycle Lock and Bracket disclosed and claimed in U.S. Letters Pat. No. 4,155,231, granted May 22, 1979, and over the Bicycle Lock disclosed and claimed in U.S. Letters Pat. No. 4,545,224, granted Oct. 8, 1985, both assigned to a common assignee, KBL Corporation of Boston Massachusetts. See also U.S Pat. No. 4,730,470, Zane et al, "Security Lock," granted Mar. 15, 1988.

The known art of locks in general goes back centuries. Locks specifically designed for bicycle security were introduced more recently. For various relevant locks, see the U.S. Pat. No. 187,362, entitled "Shackles," that was granted to H. W. Dilg on Feb. 13, 1877. It discloses a device whereby prisoner's ankles may be shackled. German Patent No. 105,187 issued in 1898 and discloses a bicycle lock in which the legs of a U-shaped shackle must be squeezed together before they are insertable into a cross piece. German Patent No. 111,976 is an addition thereto featuring an improvement in locking the same with the aid of a Chubb lock. U.S. Pat. No. 1,036,992, granted to G. S. Franki on Aug. 27, 1912, discloses a padlock featuring a cylindrical body with a cylindrical bore. A shackle extends through slots and into the base and is secured therein by a pin on the one hand and by another pin of a locking member. German Patent No. 824,896, issued in 1951, discloses a U-shaped bicycle lock in which a spring and tumbler device engages one leg of a shackle, securing thereby the shackle to a cross piece. And U.S. Pat. Nos.: Des. 238,548 granted to R. N. Seaken on Jan. 27, 1976 and No. 4,085,600 granted to A. E. Bindari on Apr. 25, 1978 both disclose bicycle locks featuring a locking mechanism in the end of the cross piece.

A combined carrying and locking device for a cycle is disclosed in U.S. Pat. No. 4,256,322; while an antitheft device for a bicycle is shown in U.S. Pat. No. 4,271,690. U.S. Pat. No. 4,324,119 teaches a passive wheel lock for bicycles; U.S. Pat. No. 4,426,861 features a brake lock for motorcycles; and U.S. Pat. No. 4,524,591 shows a lock device for chain driven vehicles. A pick-proof locking system is shown in U.S. Pat. No. 4,584,855; while a combined vehicle and assembly locking and wrenching apparatus is disclosed in U.S. Pat. No. 4,674,306. U.S. Pat. Nos. 4,823,566 and 4,823,567 disclose padlock and locking mechanisms. A self-retracting security system for bicycles is illustrated in U.S. Pat. No. 4,870,843; while a shackle lock is disclosed in U.S. Pat. No. 4,881,387. The art is thus crowded yet remains open for improvements.

SUMMARY OF THE INVENTION

It is a principal object of the present invention to overcome some of the shortcomings of prior art devices by providing an improved bicycle lock which is both easier and more convenient to manipulate, as well as being of sturdier and of more compact construction.

More specifically, it is an object of the present invention to provide a locking device for bicycles and the like of the kind including a U-shaped shackle, formed with a pair of legs, a cooperating cross bar adapted to lock across the ends of the shackle, and means for securing the one to the other and featuring a lock mounted in the side of the cross bar and in between the legs of the shackle when the lock is assembled. The means for securing one leg of the shackle to the cross bar also functions as a fulcrum, permitting a tilting movement between the two parts, required in assembling and disassembling them. Preferably, the cross bar extends beyond the parallel outer profiles of the shackle's legs less than twice the diameter of one of those legs, resulting in a compact and sturdy design. Preferably, the means for securing one leg of the shackle to the cross bar comprises a bent foot sloping at an obtuse angle.

The lock preferably is removably mounted flush with and in the side of the cross bar and includes a member designed for limited axial displacement between a locking and a non-locking position relative to one end of the U-shaped shackle. The lock is securely held in place within the cross bar by either a ring or by a second member complementary to the first member, and encasing the lock. The lock preferably is a dead bolt lock. Preferably the cross bar and the first and second members define a cross section of one of a group comprising circular, rectangular, oval, pentagonal, hexagonal and octagonal.

A plastic cover preferably encloses at least the cross bar and is preferably formed of two parts slidably fitted over the cross bar over its respective ends. Centrally, the two parts can be secured to each other, inter alia, by welding or gluing the abutting or superimposed edges thereof. Preferably, means is provided on the lock to keep it free from dirt and dust, and the like.

Other objects of the present invention will in part be obvious and will in part appear hereinafter.

The invention accordingly comprises the locking device of the present disclosure, its components, parts and their interrelationships, the scope of which will be indicated in the appended claims.

BRIEF DESCRIPTION OF THE DRAWINGS

For a fuller understanding of the nature and objects of the present invention, reference is to be made to the following detailed description, which is to be taken in connection with the accompanying drawings, wherein.

DETAILED DESCRIPTION OF THE PREFERRED EMBODIMENTS

Figure 1:
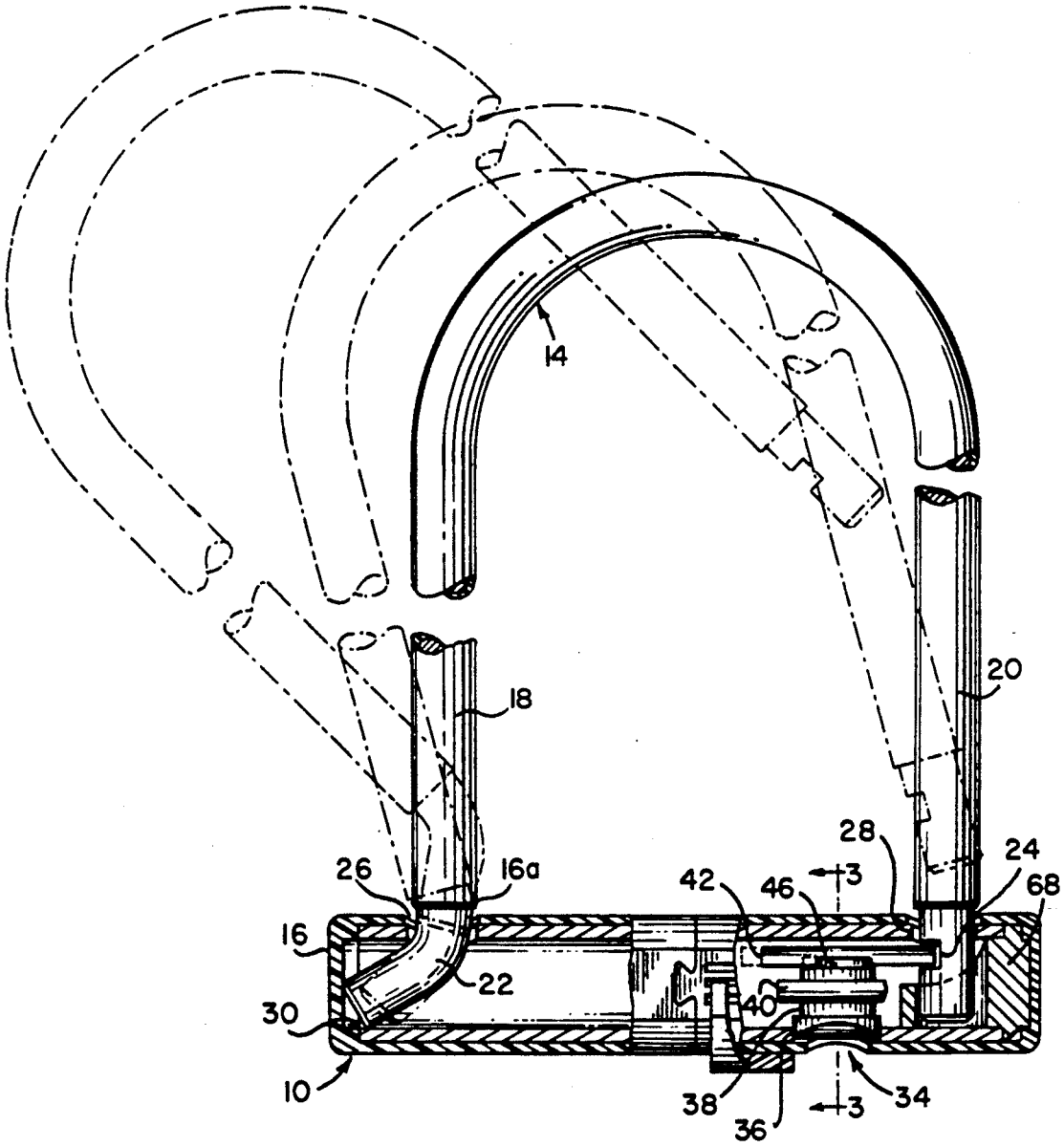
FIG. 1 is a view in elevation and partly in section of a locking device for bicycles and the like constructed in accordance with the present invention.

Generally, the illustrated embodiment of an improved locking device 10 for securing bicycles and the like to a fixed object, such as a post, not shown, comprises a cross bar 12 shown in section in FIG. 1 and a U-shaped shackle 14 shown in fragmentary elevation, both in solid lines and in phantom.

Both the cross bar 12 and the shackle 14 preferably are made from a heat treated high grade hardened steel, and both are sufficiently sturdy and thick to present effective resistance to the action of a bolt cutter or a hack saw or a lever. The cross bar 12 preferably is of hollow tubular construction while the shackle 14 preferably is made from solid cylindrical rod stock. A covering skin 16 and **16*a* is shown provided on the outer surfaces of both the cross bar 12, and the shackle 14, respectively. Alternatively, the cross bar 12 also can be formed of hollow tubular internal construction but with different outer peripheries, such as rectangular, oval, pentagonal, hexagonal and octagonal, as respectively illustrated in FIGS. 9–13. If desired, the shape of the internal construction of the cross bar 12** can follow its respective outer periphery.

The covering skin 16 and **16*a* preferably is provided to protect the finished surfaces of the bicycle against scratching when the locking device is applied. The covering skin 16 and 16*a* may be clear or colored and preferably is made of plastic or rubber, with the skin 16*a* being applied to the shackle 14 in any known manner as by dipping or by fitting a flexible sleeve over the shackle 14**, as desired.

Figures 1A, 1B, 1C, 1D, 1E:
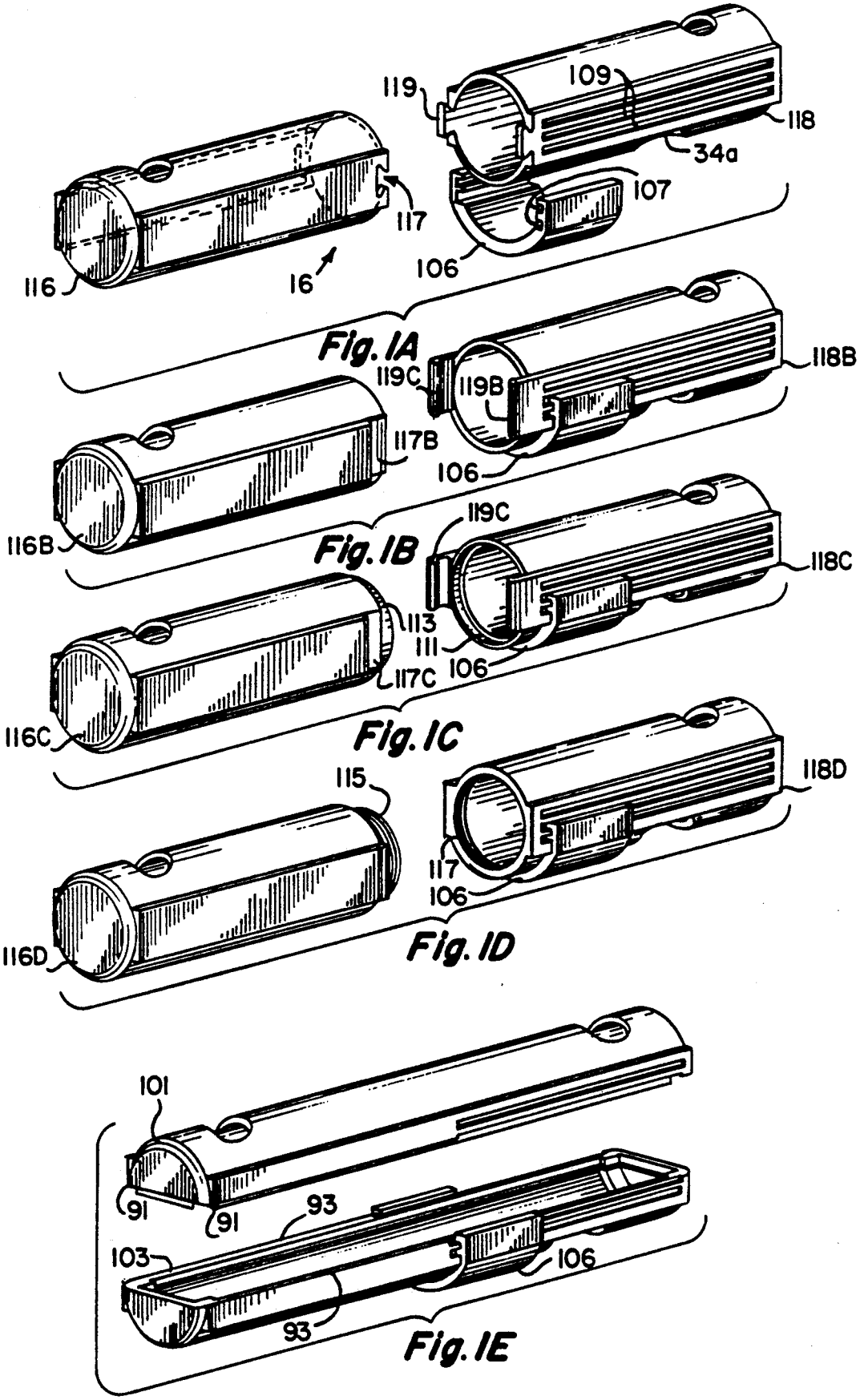
FIG. 1A is a perspective view of the cover for one part of the locking device of FIG. 1.
FIG. 1B–1E are perspective views of various other covers for the one part of the locking device of FIG. 1.

Applying the skin 16 to the cross bar 12 also can take several forms. As illustrated in FIGS. 1 and 1A, the skin 16 comprises two parts 116 and 118 which are slipped over the respective ends of the cross bar 12 and secured to one another by an interlocking hook 117 and eye 119 arrangement, respectively provided on the parts 116 and 118. A slidable lock cover 106 preferably is provided to cover the hole **34*a* that fits over the locking mechanism 34 and, when in place, provides dirt and dust protection therefor. Preferably, the lock cover 106 is formed with internal ribs 107 designed to project into and slide within cooperating tracks 109 provided on the part 118. The lock cover 106, being formed of a deformable plastic or rubber, is snapped in place, as shown in FIGS. 1 and 1B through 1E**.

The two parts of the skin 16 covering the cross bar 12 also can take the shape and construction as illustrated in FIGS. 1B through 1D, as well as illustrated in FIG. 1E. The parts 116B and 118B illustrated in FIG. 1B differ from those described above in that their method of joining to one another is effected by the provision of a pair of projections 119B provided with hooked edges and fitting over appropriately shaped cooperative parts 117B, as by being snapped or twisted thereover. The parts 116C and 118C illustrated in FIG. 1C are similar to those shown in FIG. 1B and differ therefrom only in further providing an annular depression 111 in one part 118C and a thereinto projecting annular projection 113 provided in part 116C. The parts 116D and 118D illustrated in FIG. 1D are joined together as by being screwed to one another by the provision of a helical ridge 115 formed on part 116D being screwed into a corresponding helical groove 117 formed in the other part 118D. In either of the above embodiments, a suitable cement also can be employed, if desired.

In the embodiment illustrated in FIG. 1E, the two halves 101 and 103 are cut along their axial lengths and are provided with cooperating pairs of edges 91 and 93. With the application of either cement or sonic welding to these pairs of superimposed edges 91 and 93, the two halves 101 and 103 can be effectively joined to each other.

The shackle 14 is generally U-shaped and formed with a pair of legs 18 and 20 of substantially the same length. The legs 18 and 20 can be cylindrical or oval, depending on the end use. The leg 18 terminates in a bent end or foot 22. The foot 22 preferably is sloping outwardly at an obtuse angle from the longitudinal axis of the leg 18, substantially as shown. The leg 20, on the other hand, is straight and is provided with a transverse cut 24 facing toward the bent foot 22 of the leg 18.

The cross bar 12 is formed with a pair of aligned openings 26 and 28 in the upper side thereof. The openings 26 and 28 are spaced apart from one another by a distance corresponding to the distance between the legs 18 and 20 of the U-shaped shackle 14. The opening 26 is located near one end 30 of the tubular cross bar 12 and is somewhat oblong while the opening 28 is circular in cross section and located near the other end 32.

THE EMBODIMENT OF FIGS. 1–4

A first preferred embodiment of an improved locking device according to the invention is illustrated in FIGS. 1–4. In this embodiment as well as in the other preferred embodiments hereinafter illustrated and described, a locking mechanism 34 is mounted in a side of the tubular cross bar 12 adjacent its end 32. It should be noted that the locking mechanism 34 is entirely disposed in the cross bar 12 in between the pair of legs 18 and 20, i.e., in between the pair of aligned openings 26 and 28. This mounting of the lock 34 in the side of the cross bar 10 is utterly unlike that taught by the prior art (note, inter alia, the U.S. Pat. No. 4,545,224), where the lock is mounted in the end of the cross bar. The locking mechanism 34 is mounted through a hole 36 formed in the side of the tubular cross bar 12 and diametrically but offsettingly opposed to the locations of the pair of openings 26 and 28, observe FIG. 1. As is evident from FIG. 1, the hole's 36 axis is parallel to, but is offset from, the axis of the opening 28. Consequently, a cylinder 38 of the locking mechanism 34 will enter into the interior of the tubular cross bar 12 in a space adjacent but not conflicting with that occupied by the leg 20 of the U-shaped shackle 14. The locking mechanism 34 preferably is so constructed that it does not protrude from the outer surface of the cross bar 12 so as to present a smooth outward appearance.

Figure 4:
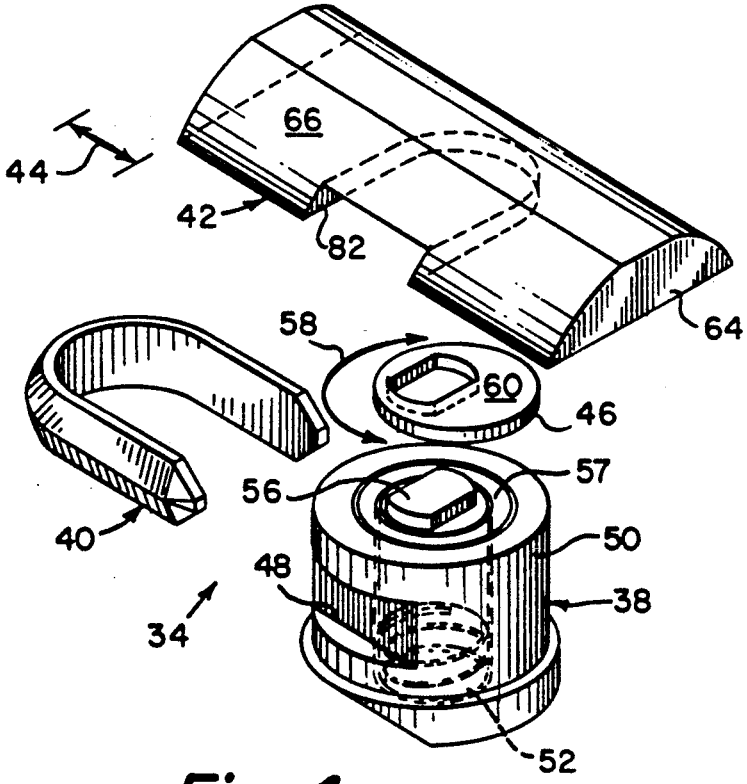
FIG. 4 is an exploded perspective view of the locking mechanism of the device shown in FIG. 1 but on an enlarged scale.

The locking mechanism 34, as best observed in FIG. 4, comprises the lock cylinder 38, a horseshoe-shaped yoke 40 designed to secure the lock cylinder 38 within the tubular cross bar 12, an elongated dead bolt, 42 that is cresent-shaped in cross section and is designed for limited positive axial displacement, as indicated by an arrow 44, and a cam 46 operatively coupling the lock cylinder 38 to a crescent-shaped seat 62 in dead bolt 42 so as to impart thereto the limited positive axial displacement between two operative positions: a first operative position, shown in solid lines in FIG. 1, in which the dead bolt 42 extends into the transverse cut 24 of the leg 20 of the U-shaped shackle 14, and a second position, shown in phantom in FIG. 1, in which the dead bolt 42 is withdrawn from the transverse cut 24, enabling thereby the removal of the leg 20 of the shackle 14 from within the opening 28 of the cross bar 12.

The lock cylinder 38 is formed with a pair of spaced parallel channels 48 and 50 about its periphery to accommodate the horseshoe-shaped yoke 40. The yoke 40, when in place about the lock cylinder 38, abuts on both sides against the inside surface of the tubular cross bar 12 as can be best observed in FIG. 3, and holds thereby the lock cylinder 38 securely within the cross bar 12. The lock cylinder 38 further is provided with a compression spring 52, the force of which needs to be overcome by a key 54 when the same is inserted into the cylinder 38 in order to operate the locking mechanism 34. Key 54 only can be inserted into and removed from the lock cylinder 34 when the locking mechanism 34 is in its locked position, illustrated in solid lines in FIG. 1. The key 54 remains firmly anchored in the lock cylinder 38 when the locking mechanism 34 is in its unlocked position. Lock cylinder 38 further is provided with a centrally located protruding shaped part 56 which rotates, together with a cylindrical member 57, when the key 54, properly inserted therein, is rotated about a ninety-degree arc, as illustrated by an arrow 58. Operative part 56 is contoured to fit within a cutout 60 formed in the cam 46. The cam 46 is, in turn, shaped to be accommodated within the cresent-shaped seat 62 formed in the underside flat surface 64 of the dead bolt 42. Due to the off-center location of the cutout 60 in the cam 46, the same imparts the limited positive axial displacement to the dead bolt 42 when the cam 46 is rotated within the seat 62.

With the outer surface of the dead bolt 42 contoured, as at 66, so as to approximate the inside surface of the tubular cross bar 12, bolt 42 frictionally engages and rides against such inside surface of the cross bar 12. In doing so, bolt 42 not only strengthens the cross bar 12 adjacent its end 32 but, more importantly, it also serves as a solid dead-bolt, when in place as shown in FIG. 1, in firmly retaining the leg 20 of the U-shaped shackle 14 therein. An appropriately shaped end plug 68 preferably is employed, both to seal the end 32 of the cross bar 12 and also to serve as a guide for the entry and withdrawal of the leg 20 via the opening 28 into the interior of the cross bar 12, as shown. Preferably, the end plug 90 is formed of metal or a hard plastic material and is secured in place, as for example by a suitable adhesive, not shown. Preferably, the end of the skin 16 is reduced somewhat in diameter near the end 32 so as to present a neat appearance and further to retain the plug 68 in place.

The bicycle lock 10 of the invention also features short stub ends at the respective ends 30 and 32 of the cross bar 12, resulting in a compact and sturdy design. The stub ends refer to that part of the cross bar 12, observe FIG. 1, which extend outwardly from the respective outer periphery of the pair of openings 26 and 28 to the respective ends 30 and 32 of the cross bar 12. The stub near the end 30 is about the size of the diameter of the leg 18, while the stub near the other end 32 is somewhat shorter, i.e., about one-half of the diameter of the leg 20. The end of the bent foot 22 is shown as extending somewhat beyond the end 30 of the cross bar 12. The skin 16 effectively covers the slight protrusion of the foot 22 beyond the end 30.

Figure 2:
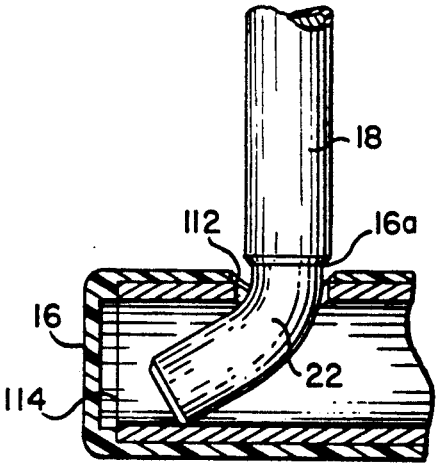
FIG. 2 is a fragmentary view of a modification of the locking device shown in FIG. 1.
Figure 3:
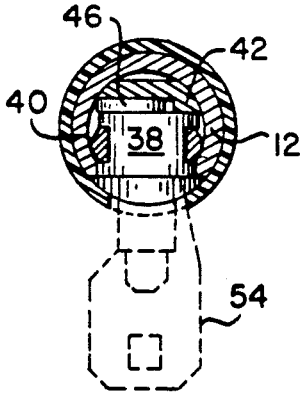
FIG. 3 is a section of the device of FIG. 1 along the lines 3—3 thereof.

In FIG. 2, there is illustrated, in fragmentary section, a modification in the bicycle lock according to the invention and pertaining to the size of the stub ends, above discussed with reference to FIG. 1. A cross bar 110 is shown provided with an opening 112 near its end 114 designed to accommodate the bent foot 22 of the leg 18 of the shackle 14, all as previously described. The within illustrated stub end, i.e., the distance of the cross bar 110 extending outwardly from the outermost profile of the opening 112 to the end 114, is greater than the diameter of the leg 18 but is less than twice the diameter thereof. Consequently, in this embodiment, the end of the bent foot 22 does not even reach the end 114 of the cross bar 110, much less protruding therefrom.

THE EMBODIMENT OF FIGS. 5-6

Figure 5:
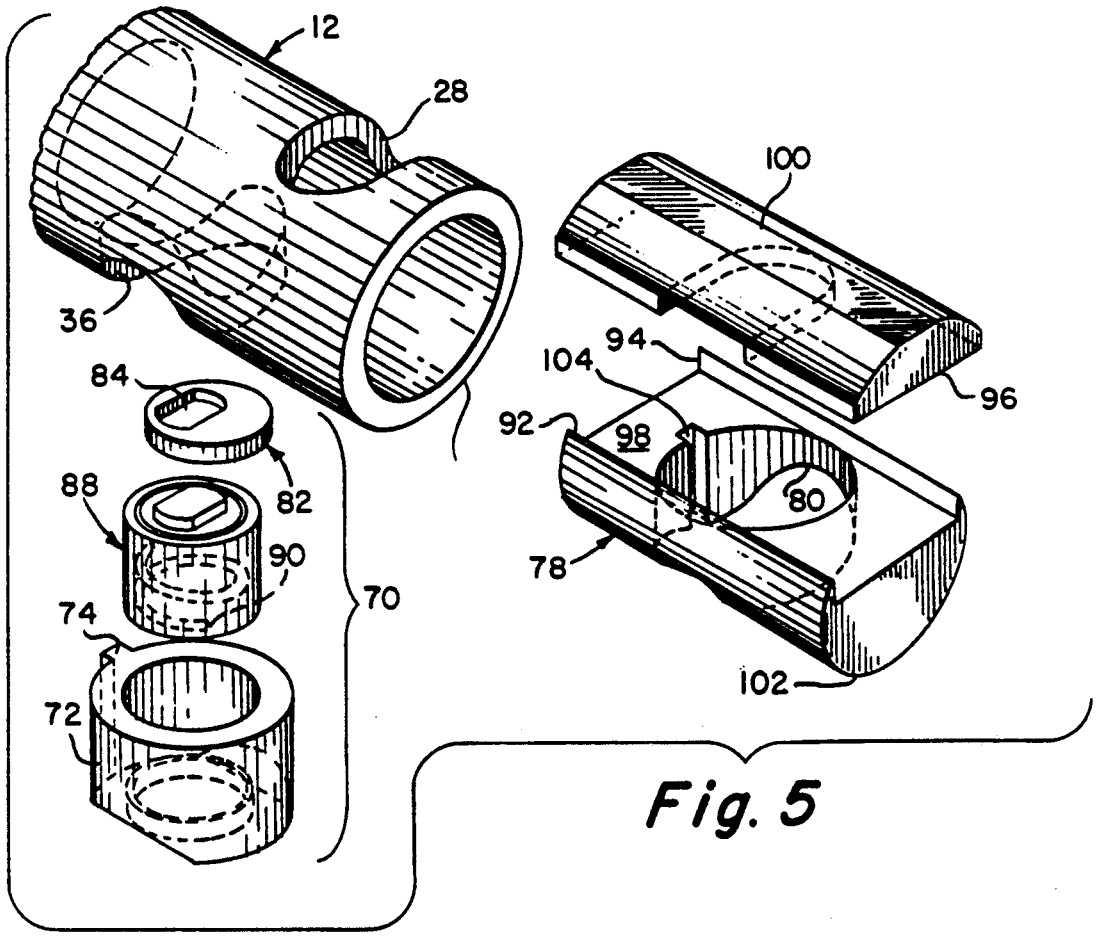
FIG. 5 is an exploded perspective of parts of another embodiment of a locking mechanism according to the invention.
Figure 6:
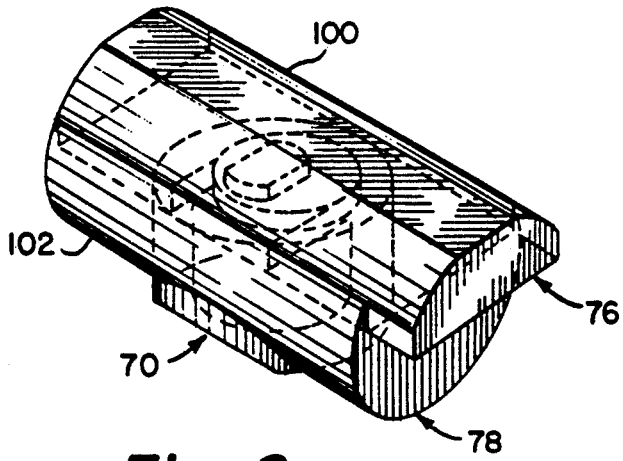
FIG. 6 is a perspective view of the parts shown in FIG. 5 but now in assembled condition.

A second preferred embodiment of an improved locking device according to the invention is illustrated in FIGS. 5-6. Also in this embodiment, a locking mechanism 70 is mounted in a side of the tubular cross bar 12 and within the hole 36 formed therein near its end 32. The design of the lock 70 is similar to that of the lock 34 shown in and described with reference to FIGS. 1-4. The lock 70 has, however, been strengthened even further against the forceful removal of the shackle 14 from the tubular cross bar 12.

Locking mechanism 70 essentially comprises a lock cylinder 72 provided with a rib 74 designed to secure the lock cylinder 72 within the tubular cross bar 12, a first dead bolt member 76, that is cresent shaped in cross section and designed for limited positive axial displacement, which member 76 is similar to the deadbolt 42 of FIGS. 1-4, a second elongated guide member 78, complementary to the first dead bolt member 76 and provided with a bore 80 to receive the lock cylinder 72, and a cam 82, which is identical to the cam 46, operatively coupling the lock cylinder 72 to the dead bolt member 76 so as to impart thereto the same limited positive axial displacement between its two operative positions as described above with reference to FIGS. 1–4.

The cam 82 also is formed with a cutout 84 designed to receive a protruding operative part 86 of a cylindrical member 88. Member 88 also incorporates a spring 90 which functions just like the spring 52.

The elongated guide member 78 is provided with a pair of guide edges 92, 94 to facilitate the limited positive axial displacement of the first dead bolt member 76 relative thereto. A bottom flat surface 96 of the first dead bolt member 76 is designed frictionally to slide over a flat bed 98 formed in the second elongated guide member 78 in between its guide edges 92 and 94. It will be appreciated, especially when viewing FIG. 6, that the outer peripheries 100 and 102 respectively, of the first and second members 76 and 78 are both contoured so as to approximate the inner surface of the tubular cross bar 12 and, that the cross section of the combined members 76 and 78 substantially fills up the hollow space inside the tubular cross bar 12.

In the wall of the bore 80 formed in the second elongated guide member 78, there is provided a channel 104 which is designed to accommodate therein the rib 74 of the lock cylinder 72, securing thereby the lock cylinder 72 in and to the surrounding second guide member 78. Due to the combined effects of the rib 74 extending into the channel 104 of the member 78, both the lock cylinder 72 and the elongated guide member 78 are secured to one another as well as within the cross bar 12 against displacement therein. By inserting and turning a key, not shown, into the lock cylinder 72, in a way identical to that shown in and described with reference to FIGS. 1–4, the first dead bolt member 76 is caused to be displaced axially between its first operative position illustrated in FIG. 6, extending into the transverse cut 24 of the leg 20 of the U-shaped shackle 14, as shown in FIG. 1, and a second operative position, not shown in FIG. 6, in which it is withdrawn from the transverse cut 24.

THE EMBODIMENT OF FIGS. 7–8

Figure 7:
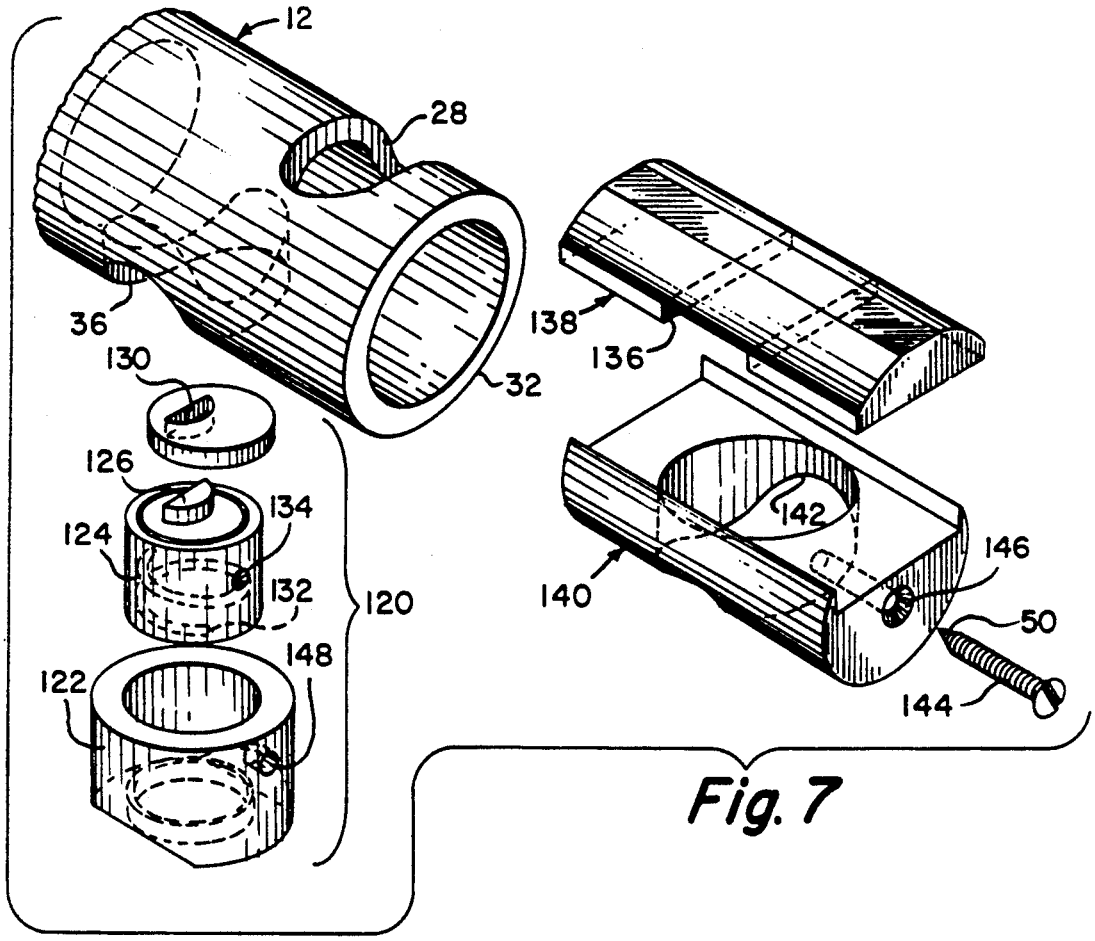
FIG. 7 is a view similar to FIG. 5 but showing a further embodiment of a locking mechanism according to the invention.
Figure 8:
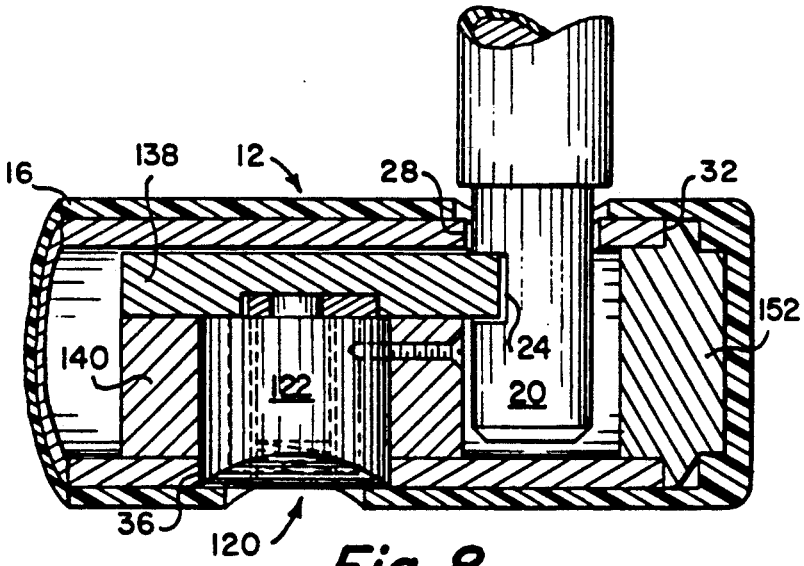
FIG. 8 is sectional view illustrating the embodiment of the locking mechanism of FIG. 7 in a locked position.

A third preferred embodiment of an improved locking device according to the invention is illustrated in FIGS. 7–8. Also in this embodiment, a locking mechanism 120 is mounted in the side of the cross bar 12 and within the hole 36 formed therein near its end 32. The design of the lock 120 is similar to that of the lock 70 shown in and described with reference to FIGS. 5–6.

The locking mechanism comprises a lock cylinder 122, a cylindrical member 124 formed with a cresent-shaped protruding part 126, and a cam 128 formed with a cresent-shaped cutout 130 designed to accommodate the operative part 126. Member 124 also incorporates a compression spring 132 and a circular depression 134 formed about midway in its periphery, substantially as shown. Cam 128 is designed to ride within a transverse cut 136 formed in the underside of dead bolt member 138 and axially displace the same within the channel of a second member 140, substantially as described with reference to the embodiment illustrated in FIGS. 5–6. Member 140 also is provided with a bore 142 designed to receive the lock cylinder 122 therein. The securing of the various parts of the locking mechanism 120 to each other and within the cross bar 12 is herein effected with the aid of a screw 144 designed to pass through a first bore 146 formed in member 140, and a second bore 148 formed in the lock cylinder 122, with the pointed end 150 of the screw 144 coming to rest in the depression 134 of the cylindrical member 124. An end plug 152 is provided to close off the end 32 of the cross bar 12. Plug 152 differs from the end plug 68 in that it does not also serve as a guide for the entry of the leg 20, which function is now assumed by the member 140.

Figure 9:
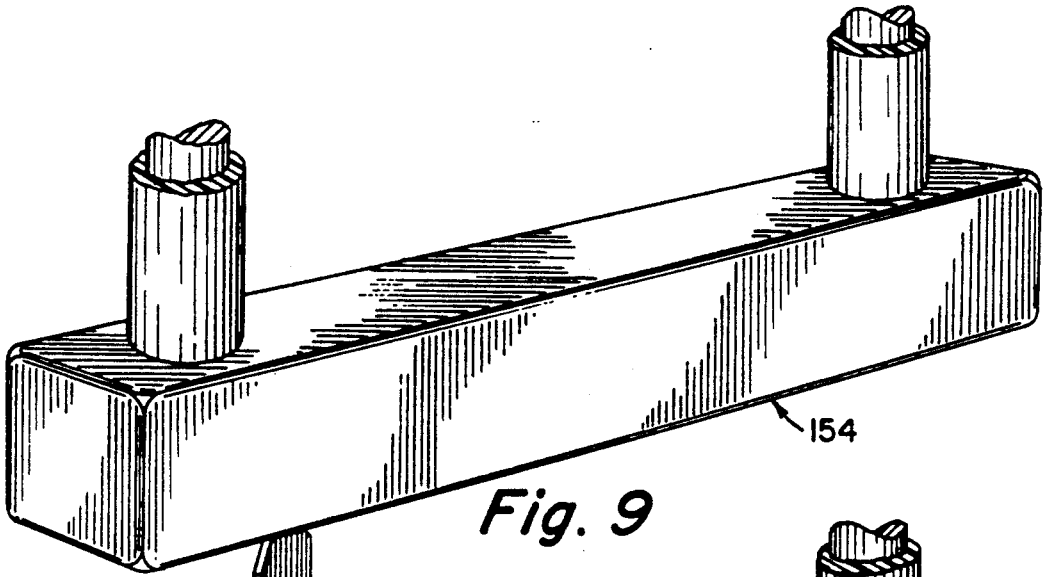
FIGS. 9–11 fragmentary perspective views of locking devices of different shapes according to the invention.
Figure 10:
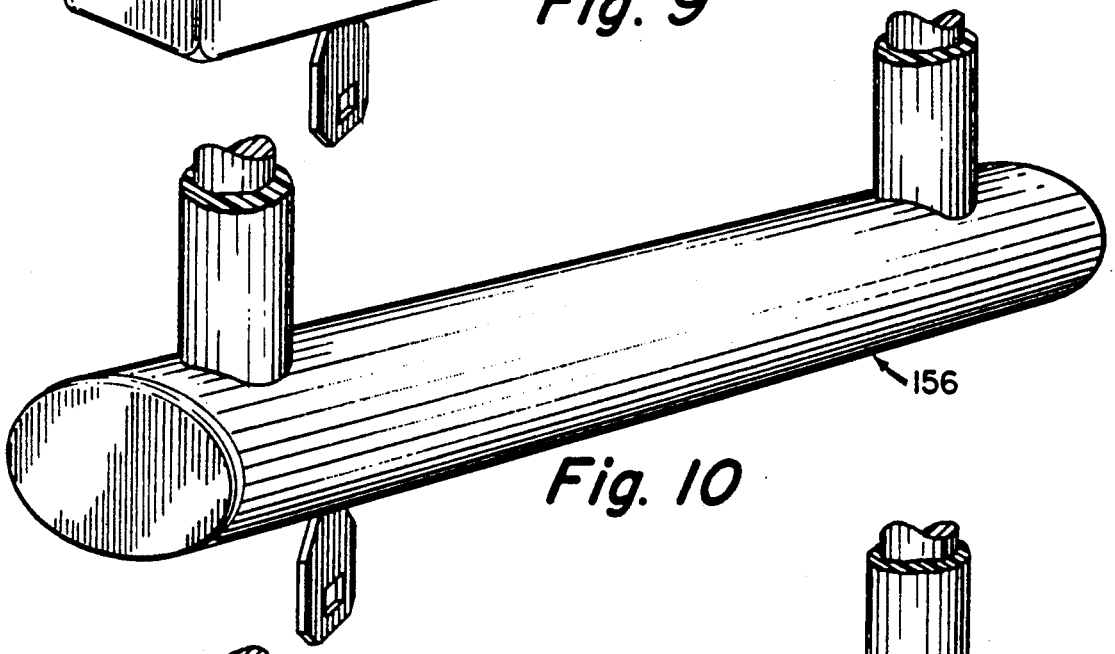
Figure 11:
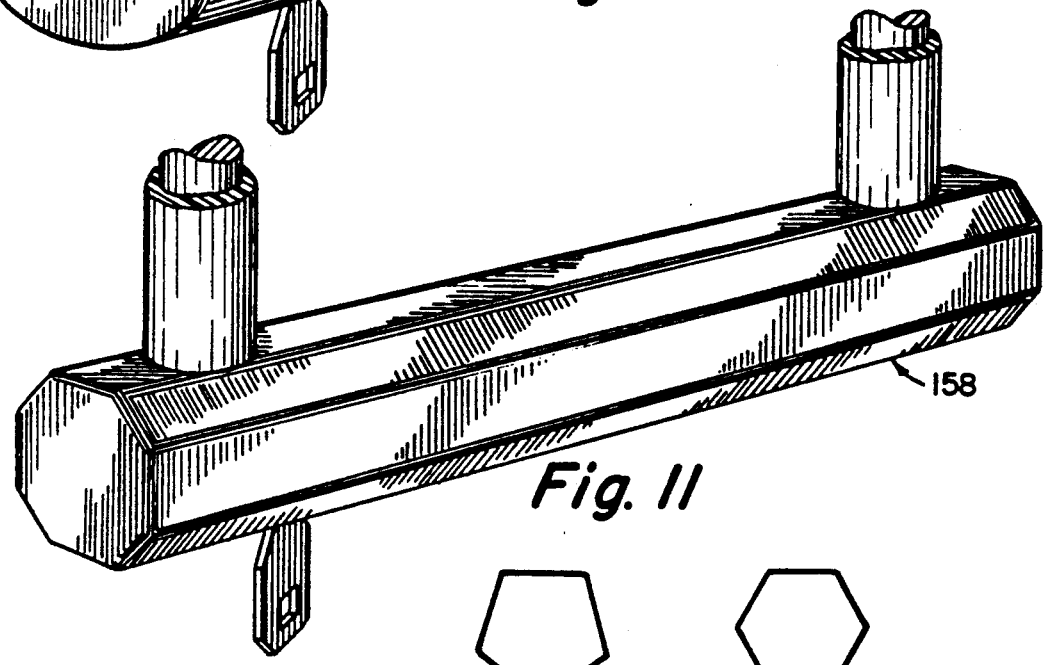
Figure 12:
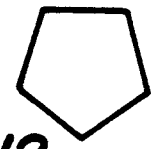
FIGS. 12–13 are illustrative of further shapes, in cross section, of a part of locking devices according to the invention.
Figure 13:
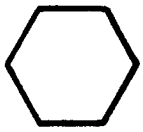

FIGS. 9–11 illustrate bicycle locks in fragmentary perspective and according to the invention in which the cross bars thereof are formed with different shapes and are shown without any skin covers. For example, in FIG. 9 a cross bar 154 of rectangular shape is illustrated, while FIG. 10 illustrates a cross bar 156 of oval shape, and FIG. 11 a cross bar 158 of octagonal shape. FIGS. 12–13 illustrate, in cross section, still further shapes for a cross bar, namely a pentagonal and a hexagonal shape, respectively. In each instance, the internal shape of the respective cross bar can be tubular or, if desired, it can match its respective outer shape. If the latter, then of course the locking mechanism mounted therein also need be reshaped to be properly accommodated therein.

Thus, it has been shown and described an improved locking device for securing a bicycle or the like to a fixture, which device satisfies the objects and advantages set forth above.

Since certain changes may be made in the present disclosure without departing from the scope of the present invention, it is intended that all matter described in the foregoing specification or shown in the accompanying drawings, be interpreted in an illustrative and not in a limiting sense.

What is claimed is:

1. In a bicycle lock comprising:

(a) a U-shaped shackle and a cross bar designed to lock across the open end of said shackle;

(b) said shackle formed with a pair of legs, one of said legs formed at its free end with means for securing said shackle at said free end to one end of said cross bar, said means also serving as a fulcrum to allow for a tilting motion between said shackle and said cross bar, the other of said legs formed at its free end with a lock engaging portion;

(c) a locking mechanism mounted in the side of said cross bar in between said pair of legs of said shackle;

(d) said locking mechanism including a dead bolt designed to engage said lock engaging portion of said other of said legs of said shackle, said dead bolt having two operative positions: a locking position in which said bolt extends into said lock engaging portion and, a non-locking position in which said bolt is withdrawn from said lock engaging portion, said dead bolt is designed to reciprocate between said two operative positions as effected by said locking mechanism when it is manipulated by a detachable key;

(e) means removably to secure said locking mechanism within said cross bar;

the improvement wherein both said U-shaped shackle and said cross bar are covered by a plastic skin.

2. In the bicycle lock of claim 1 wherein said plastic skin for said cross bar is formed of two parts cut along their axial lengths and respectively provided with cooperating pairs of edges.

3. In the bicycle lock of claim 2 wherein said cooperating paris of edges of said two axially cut parts, once in place and enveloping said cross bar, are secured to one another to securely hold said plastic skin on said cross bar.

4. In the bicycle lock of claim 3 wherein said securing of said cooperating pairs of edges to one another is effected by cement.

5. In the bicycle lock of claim 3 wherein said securing of said cooperating pairs of edges to one another is effected by sonic welding.

6. In the bicycle lock of claim 1 wherein said plastic skin for said cross bar is formed of two tubular parts and slid over the respective ends of said cross bar and secured to one another by an interlocking hook and eye arrangement and respectively provided on said two tubular parts.

7. In the bicycle lock of claim 6 wherein one of said two tubular parts is further provided with a slideable lock cover.

8. In the bicycle lock of claim 1 wherein said plastic skin for said cross bar is formed of two tubular parts respectively provided with a pair of projections provided with hooked eyes and fitting over appropriately shaped cooperative parts, said pair of projections operatively engaging said parts.

9. In the bicycle lock of claim 1 wherein said plastic skin for said cross bar is formed of two tubular parts, one of which is provided with an annular depression and the other with an annular projection operable to engage one another and secure thereby said tubular parts to each other.

10. In the bicycle lock of claim 1 wherein said plastic skin for said cross bar is formed of two tubular parts, one of which is provided with a helical groove and the other with a helical ridge operable to engage said groove when secured thereto, securing thereby said tubular parts to one another.

* * * * *